US007825945B2

(12) United States Patent
Busch et al.

(10) Patent No.: US 7,825,945 B2
(45) Date of Patent: Nov. 2, 2010

(54) THERMAL PRINTER WITH AUXILIARY HEAT SINK AND METHODS FOR PRINTING USING SAME

(75) Inventors: Brian Busch, Sudbury, MA (US); Stephen J. Telfer, Arlington, MA (US); Juan Carlos Van Dijk, Sudbury, MA (US); William T. Vetterling, Lexington, MA (US); Peter Zelten, Melrose, MA (US)

(73) Assignee: Zink Imaging, Inc., Bedford, MA (US)

( * ) Notice: Subject to any disclaimer, the term of this patent is extended or adjusted under 35 U.S.C. 154(b) by 266 days.

(21) Appl. No.: 11/856,482

(22) Filed: Sep. 17, 2007

(65) Prior Publication Data

US 2008/0211899 A1 Sep. 4, 2008

Related U.S. Application Data

(60) Provisional application No. 60/845,297, filed on Sep. 18, 2006.

(51) Int. Cl.
*B41J 29/377* (2006.01)

(52) U.S. Cl. ..... 347/223

(58) Field of Classification Search ..... 347/223
See application file for complete search history.

(56) References Cited

U.S. PATENT DOCUMENTS

| | | | |
|---|---|---|---|
| 4,232,552 | A | 11/1980 | Hof et al. |
| 4,641,147 | A | 2/1987 | Skaura et al. |
| 4,819,011 | A | 4/1989 | Yokota |
| 5,278,031 | A | 1/1994 | Boggs et al. |
| 5,401,619 | A | 3/1995 | Boggs et al. |
| 5,534,393 | A | 7/1996 | Boggs et al. |
| 5,595,446 | A | 1/1997 | Barrus et al. |
| 5,667,943 | A | 9/1997 | Boggs et al. |
| 6,054,246 | A | 4/2000 | Bhatt et al. |
| 6,343,647 | B2 | 2/2002 | Kim et al. |
| 6,420,131 | B1 | 7/2002 | Miller et al. |
| 6,537,410 | B2 | 3/2003 | Arnost et al. |
| 6,801,233 | B2 | 10/2004 | Bhatt et al. |
| 7,176,161 | B2 | 10/2004 | Chu et al. |

FOREIGN PATENT DOCUMENTS

| | | |
|---|---|---|
| GB | 1298462 | 12/1972 |
| JP | 62288828 | 12/1987 |
| JP | 04213368 | 8/1992 |

OTHER PUBLICATIONS

Beilstein Institute for Organic Chemistry, Frankfurt, Germany; (1988-2001); XP-002290704, pp. 1-4.

(Continued)

*Primary Examiner*—Huan T Tran
(74) *Attorney, Agent, or Firm*—James F. Ewing; Michel Morency; Foley & Lardner LLP

(57) ABSTRACT

The present invention provides a thermal printer in which the temperature of the thermal printing head can be modulated by means of an auxiliary heat sink, and methods for printing using such a thermal printer.

16 Claims, 6 Drawing Sheets

OTHER PUBLICATIONS

Beilstein Institute for Organic Chemistry, Frankfurt, Germany; (1988-2001); XP-002290705, pp. 1-2.

Beilstein Institute for Organic Chemistry, Frankfurt, Germany; (1988-2001); XP-002290706, pp. 1-2.

Beilstein Institute for Organic Chemistry, Frankfurt, Germany; (1988-2001); XP-002290707, pp. 1-2.

Beilstein Institute for Organic Chemistry, Frankfurt, Germany; (1988-2001); XP-002290708, pp. 1-2.

PCT International Search Report; Date of mailing Aug. 13, 2004; 2 pages.

International Search Report (PCT/US07/20096); Date of Mailing: Mar. 6, 2008; 1 page.

THERMAL PRINTER WITH AUXILIARY HEAT SINK AND METHODS FOR PRINTING USING SAME

CROSS-REFERENCE TO RELATED PATENT APPLICATIONS

The present application claims the benefit of prior provisional patent application No. 60/845,297, filed Sep. 18, 2006, the contents of which are hereby incorporated by reference herein its entirety.

This application is also related to the following commonly assigned, United States patent applications and patents, the entire disclosures of which are hereby incorporated by reference herein their entirety:

U.S. patent application Ser. No. 10/151,432, filed on May 20, 2002, entitled "Thermal Imaging System", now U.S. Pat. No. 6,801,233.

U.S. patent application Ser. No. 11/159,880, filed on Jun. 23, 2005,

U.S. patent application Ser. No. 11/400,734, filed on Apr. 6, 2006,

U.S. patent application Ser. No. 11/400,735, filed on Apr. 6, 2006,

U.S. patent application Ser. No. 11/524,476, filed on Sep. 20, 2006; and

U.S. patent application Ser. No. 11/593,218, filed on Nov. 6, 2006.

FIELD OF THE INVENTION

The present invention relates generally to a digital printing system. More specifically, the invention relates to a thermal printer in which the temperature of a thermal printing head may be modulated by means of an auxiliary heat sink, and to methods for printing using such a thermal printer.

BACKGROUND OF THE INVENTION

A thermal printer typically contains one or more thermal printing heads that comprise linear arrays of heating elements (also referred to herein as "printing head elements"). The thermal printing head is usually arranged to span the width of an output medium onto which an image is to be printed. The output medium may be an individual sheet or a continuous web comprising paper, plastic, or similar material. During printing, the output medium is transported perpendicular to the direction spanned by the thermal printing head while the printing head elements are energized in a pattern corresponding to an image. The printed image on the output medium arises from differential heating by the printing head elements. Each of the printing head elements (which may number in the hundreds per inch), when activated, forms color on the portion of the output medium passing underneath the print head element, creating a spot having a particular density. Regions with larger or denser spots are perceived as darker than regions with smaller or less dense spots. Digital images are rendered as two-dimensional arrays of very small and closely-spaced spots.

The density of the output produced by the thermal printing head element is a function of the amount of energy provided to the printing head element. The amount of energy provided to the printing head element may be varied by, for example, varying the amount of power provided within a particular time interval or by providing constant power for a longer or shorter time interval.

The mechanism of color formation on the output medium may involve transfer of a dye or pigment from a donor to a receiver sheet, or may occur through activation of color-forming chemistry in the output medium itself. The former is commonly referred to as "thermal transfer printing" and the latter as "direct thermal printing".

In International Application No. PCT/US02/15868 (which corresponds to U.S. patent application Ser. No. 10/151,432, cross-referenced above), entitled "Thermal Imaging System," there is described a direct thermal imaging system in which one or more thermal printing heads can write more than one color in a single pass on a single output medium by selectively activating color-forming chemistry in particular layers of the output medium. A printer using the pulsing techniques and output medium described in International Application No. PCT/US02/15868 can address three image-forming layers of the output medium at least partially independently from the same surface of the output medium. In this way, a full-color image in three subtractive primary colors (cyan, magenta and yellow) may be printed in a single pass onto the output medium without the need for dye donor elements, inks, etc.

Because the printer that addresses such an output medium consists essentially only of a thermal printing head, control electronics, a transport mechanism and a power supply, it has become possible to conceive of smaller printing devices than have been achievable with other printing techniques.

There are, however, situations in which it may be required to provide bulk heating or cooling of a thermal printing head in a printer, and such bulk heating or cooling may be incompatible with a requirement for a printer of small size if conventional approaches are used. The terms "bulk heating" and "bulk cooling" of the thermal printing head, as used herein, refer to such heating and cooling as affects the average temperature of the entire thermal printing head, as opposed to the heating of the printing head elements when forming an image, in which the heating is localized to the immediate vicinity of the heating element.

Bulk heating or cooling of the thermal printing head may be required for a number of reasons. For example, in the current state of the art, the efficiency with which heat is transferred into an output medium from a thermal printing head is fairly low, with the result that during the printing of an image, the thermal printing head itself is heated. It may become so hot that image discrimination may be affected, and cooling may therefore be required.

At the other extreme, the temperature of the thermal printing head may be lower than the desired operating temperature at the start of printing (especially outdoors in winter), and some pre-heating may be required before printing can commence.

In prior art printers, cooling of the thermal printing head has typically been achieved by use of a heat sink (i.e., a large thermal mass) in thermal contact with the thermal printing head. The heat sink itself is typically cooled by, for example, air or a circulating liquid. Fans are often used to assist air cooling. Heat pipes or other means of high thermal conductivity may be used to transfer heat to/from a location where cooling can be most efficient.

When heating of the thermal printing head is required, this may be achieved by activation of the printing head elements themselves, or alternatively by some other means of heating of the heat sink. Unfortunately, because the heat sink and the rest of the thermal printing head are in the thermal contact, any preheating means must provide enough energy to raise the temperature of the entire assembly.

When it is required to minimize the size of the printer, these prior art methods for cooling or heating may be inadequate. There may be insufficient space to provide for air flow or liquid for cooling. In particular, there may be no practical way to incorporate a fan into a small printer. Moreover, when the printer is intended for battery-powered operation with a minimum size, it is clearly necessary to minimize the power that must be drawn from the battery. When it is necessary to preheat the thermal printing head, therefore, it would be preferred that a mass required to be heated be as small as possible. This requirement is in conflict with the requirement for a heat sink with a large thermal mass for cooling during printing.

Even when size is not a constraint in the design of a thermal printer, it still may be desired to have additional flexibility in the heating or cooling of the thermal printing head.

SUMMARY OF THE INVENTION

It is therefore an object of this invention to provide a thermal printer in which the thermal mass that is in thermal contact with the thermal printing head is adjustable.

It is another object to provide a thermal printer having an auxiliary heat sink.

Another object is to provide a thermal printer having an auxiliary heat sink and means for adjusting the thermal conductance between the thermal printing head and the auxiliary heat sink.

Yet another object is to provide a method for printing an image using a thermal printer in which the thermal mass that is in thermal contact with the thermal printing head is adjustable.

In one aspect of the invention, a thermal printer includes a thermal printing head, which includes a support and multiple heating elements, and an auxiliary heat sink in selective thermal communication with the thermal printing head. The thermal printer also includes means for adjusting a thermal conductance between the thermal printing head and the auxiliary heat sink.

In another aspect of the invention, a process for printing using a thermal printer including a thermal printing head, a platen roller, and an auxiliary heat sink, wherein the thermal conductance between said thermal printing head and said auxiliary heat sink is adjustable, includes setting the thermal conductance to a first value. The thermal imaging member is translated relative to the thermal printing head, while the heating elements of the thermal printing head are selectively energized. A temperature of the thermal printing head is monitored, and the thermal conductance is reset to a second value if the monitored temperature exceeds a first predetermined threshold. The first value is lower than said second value.

In yet another aspect of the invention, a process for printing using a thermal printer including a thermal printing head, a platen roller, and an auxiliary heat sink, wherein the thermal conductance between the thermal printing head and the auxiliary heat sink is adjustable, includes monitoring the temperature of the thermal printing head prior to printing. A temperature of the thermal printing head is initialized to a predetermined value, while the thermal conductance is set at a first value. The thermal imaging member is translated relative to the thermal printing head, while the heating elements of the thermal printing head are selectively energized. The thermal conductance is reset to a second value if the temperature exceeds another predetermined threshold. Again, the first value is lower than said second value.

BRIEF DESCRIPTION OF THE DRAWINGS

For a better understanding of the invention as well as other objects and further features thereof, reference is made to the following detailed description of various preferred embodiments thereof taken in conjunction with the accompanying drawings (which are not to scale) wherein.

DETAILED DESCRIPTION OF THE PREFERRED EMBODIMENTS

Figure 1:
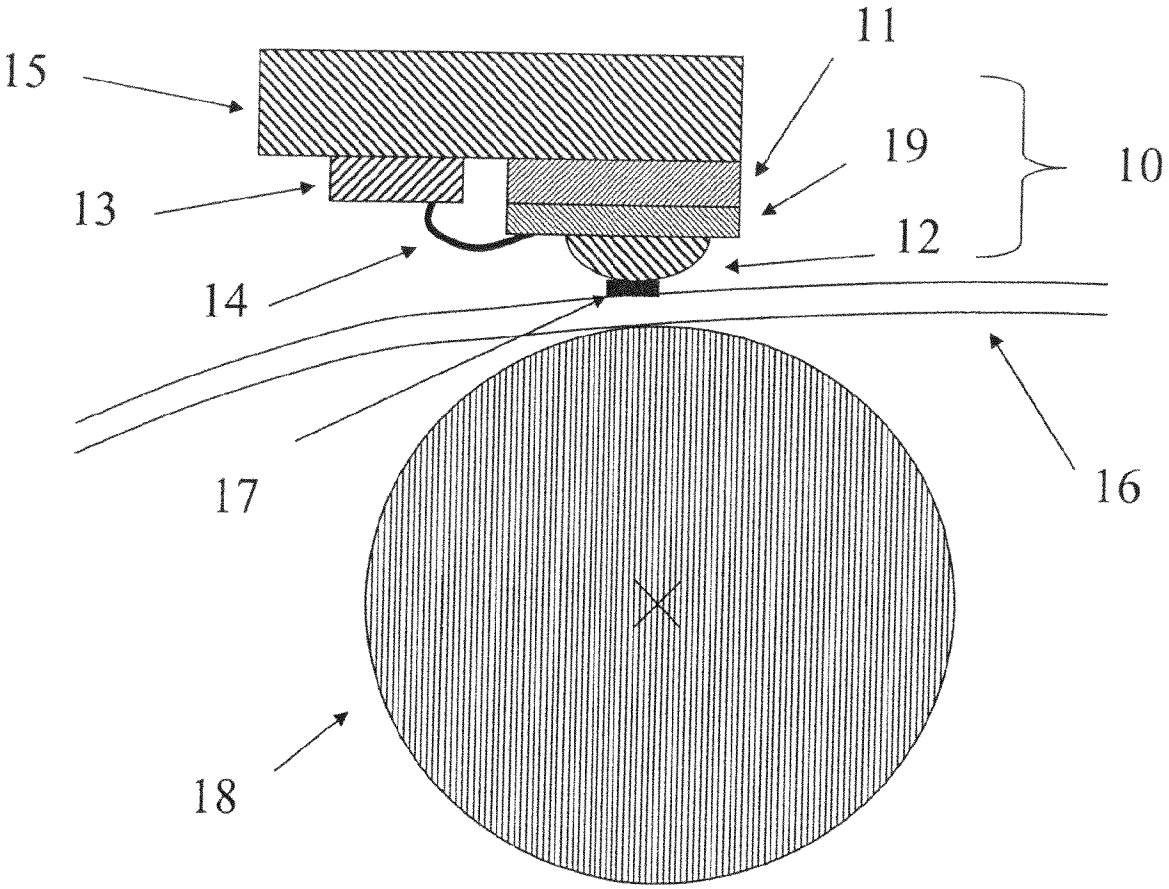
FIG. 1 is a cross-sectional view of a prior art thermal printing bead and platen arrangement.

Referring now to FIG. 1 there is shown a typical thermal printing arrangement of the prior art in which a thermal printing head 10 and a thermal imaging member 16 are held in intimate contact by a platen 18. As shown in FIG. 1, a typical thermal printing head 10 comprises a support 15 that carries the driving circuitry 13 and the assembly comprising the heating elements. The heating elements 17 are carried by a glaze layer 19 in contact with a ceramic substrate 1. Ceramic substrate 11 is in contact with support 15. Shown in the figure is an optional raised "glaze bump" 12 on which the heating elements 17 are located, but they may also be carried by the surface of glaze 19 when glaze bump 12 is absent. Wires 14 provide electrical contact between the heating elements 17 and the driving circuitry 13.

The support 15 provides mechanical strength to the printing head 10 so that it may be easily affixed to a chassis of a printer and biased against the thermal imaging member 16. Support 15 may also function as a heat sink, and is commonly made of a material of high thermal conductivity, such as aluminum. Support 15 may be provided with cooling fins for air cooling, or channels for liquid cooling. The temperature of support 15 may be monitored (by means, for example, of a thermistor), and knowledge of this temperature may be used to adjust the energy that is provided to the heating elements 17 for optimal imaging, as is known in the art and described, for example, in U.S. Pat. No. 6,819,347. The thermal mass that is in effective thermal contact with the thermal printing head 10 is not adjustable in such a printer of the prior art.

Figure 2:
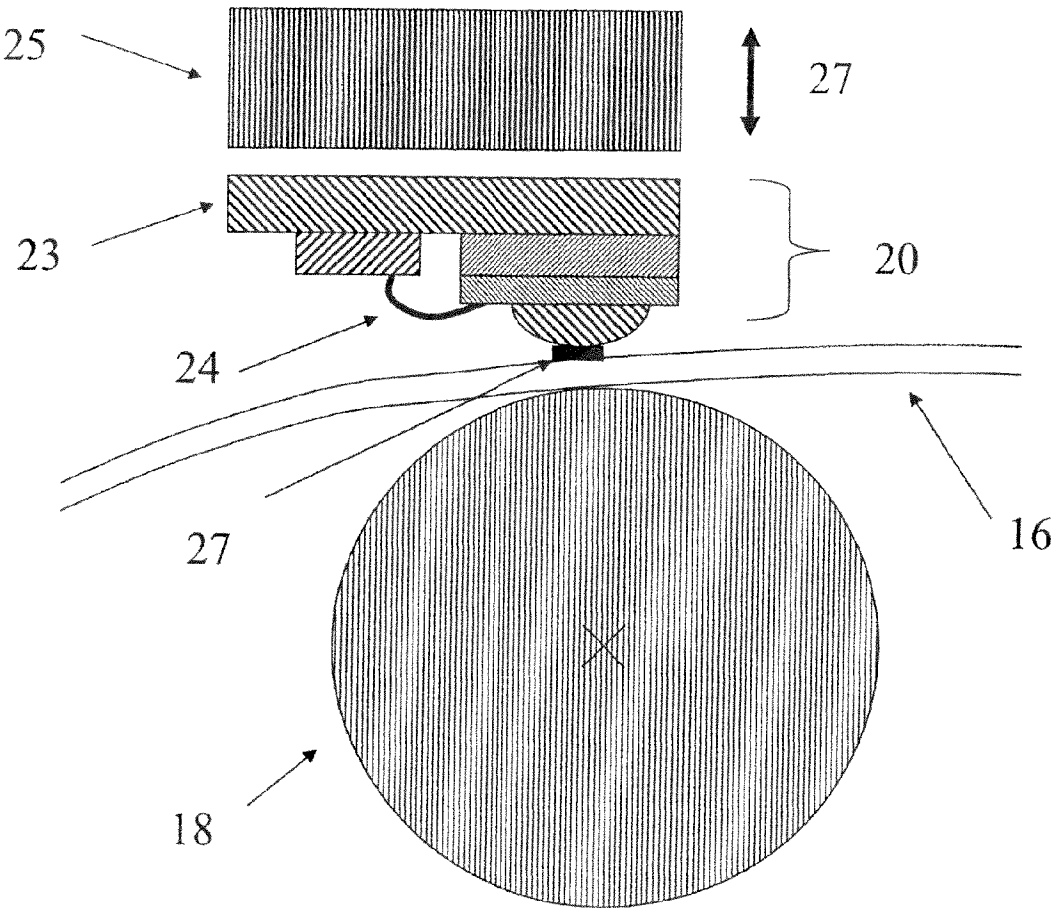
FIG. 2 is a cross-sectional view of a thermal printer of the present invention having a thermal printing head and an auxiliary heat sink.

The minimal requirement for a thermal printing head is a support, an array of heating elements, and means for supplying a controlled flow of electrical current to the heating elements. In FIG. 2 there is shown a printer of the present invention having a thermal printing head 20 comprising a support 23 bearing drive circuitry 24 and heating elements 27. Support 23 supplies the mechanical requirements described above with reference to support 25 of FIG. 1, without necessarily functioning as a substantial heat sink, although in some embodiments of the invention it may do so. Also shown in FIG. 2 is an auxiliary heat sink 25. Auxiliary heat sink 25 is capable of being repositioned so as to be brought into or out of thermal contact with support 23. Such repositioning can be accomplished by translation in the direction of arrow 27.

In its simplest form, an auxiliary heat sink 25 is merely an additional mass of material that, when in thermal contact with the thermal printing head 20, increases the effective heat capacity of the thermal printing head. The auxiliary heat sink 25 typically will have a heat capacity that is comparable with, or greater than, that of the thermal printing head 29. The auxiliary heat sink 25 may be cooled or heated by means other than the thermal printing head 20. Thus, the auxiliary heat sink 25 may be provided with cooling fins, resistive heating, circulating fluids, heat pipe, etc. As discussed in more detail below, the auxiliary heat sink 25 can serve other functions in the construction of the printer (chassis, battery, etc.). The auxiliary heat sink 25 can be equipped with a temperature sensor.

The auxiliary heat sink may also comprise a phase change material (PCM). One form of phase change material is a solid that melts at a certain temperature. As heat is supplied to a phase change material, its temperature rises until reaching the melting point. At this point, further heating causes no further increase in temperature until the latent heat required to melt all the phase change material has been supplied. An alternative phase change material is a liquid that vaporizes upon being heated to its boiling point. Use of a phase change material allows maintenance of a constant temperature more effectively than using a simple thermal mass. When a phase change material is used, it is preferably encapsulated so that liquid or gaseous material does not leak out. For example, the auxiliary heat sink 25 includes a reservoir storing the phase change material.

The operation of the printer shown in FIG. 2 is as follows. In situations in which it is required to preheat the thermal printing head 20, auxiliary heat sink 25 is maintained out of thermal contact with the thermal printing head 20. In this way, the amount of energy required for the bulk preheating of the thermal printing head 20 may be minimized. Preheating of the thermal printing head 20 may be achieved by passing current through heating elements or by some other means as will be clear to one of ordinary skill in the art.

At the start of printing, in one preferred method, auxiliary heat sink 25 is maintained out of thermal contact with thermal printing head 20. As mentioned above, thermal printing head 20 may be equipped with a temperature sensor that records the bulk temperature of the thermal printing head. If, during printing, this temperature exceeds a certain predetermined value, auxiliary heat sink 25 is brought into better thermal contact with thermal print head 20. If the temperature of the auxiliary heat sink 25 is lower than that of the thermal printing head 20, bringing the two into better thermal contact will lead to cooling of the thermal printing head. In this way, the use of a cooling fan or other cooling means can be avoided. As mentioned above, when it is desired to make a compact printer, incorporation of a cooling fan may be precluded for reasons of size. Preferably the rate of cooling of the thermal printing head 20 by the auxiliary heat sink 25 is sufficiently slow such that a thermistor (or other temperature sensor) measuring the temperature of the thermal printing head records a sufficiently accurate temperature for assuring well-controlled printing.

In some embodiments, the printer includes a controller. The controller can be configured to receive temperature values are reported from any thermal sensors that may be provide in the system. The controller can be configured to adjust thermal conductivity in response to one or more of any of the reported temperatures. The controller implements logic for adjusting thermal conductivity, as required, according to the reported temperature and one or more predetermined threshold values. In some embodiments, the controller is in the form of a processor running stored program code. The controller may also be provided with access to stored values, such as threshold temperature values. In some embodiments, the controller is implemented within the print controller.

In some embodiments, the system also includes one or more actuators configured to move one or elements of the printer in order to adjust thermal conductivity. For example, a thermal sensor monitors a temperature of the thermal printing head and reports the value to the controller. The controller processes the reported temperature determining if thermal conductivity should be adjusted. Depending upon the result, the controller instructs the actuator to move the thermal printing head with respect to the auxiliary heat sink as required to control thermal conductivity. Alternatively or in addition, the controller may control the flow of thermal transfer fluid in order to alter temperature of the thermal printing head. The process can be repeated as required given the monitored temperature and the current state in the print process.

Whatever the relative temperature of the thermal printing head 20 and the auxiliary heat sink 25, bringing the two into better thermal contact will increase the thermal mass (i.e., the heat capacity) of the material that is in thermal contact with the thermal printing head 20, and therefore reduce the rate at which the bulk temperature of the thermal printing head 20 increases during printing.

Although a single auxiliary heat sink 25 is shown in FIG. 2, it is possible that multiple auxiliary heat sinks may be employed for finer tuning of the heat capacity of the system and the temperature during printing. The thermal conductance between the thermal printing head and each of the auxiliary heat sinks may be independently adjustable. This could include independent adjustment of each of the multiple auxiliary heat sinks either in thermal contact or not with the thermal printing head 20.

As mentioned above, when auxiliary heat sink 25 is used for cooling, it should be lower in temperature than thermal printing head 20 when the two are brought into contact. Additional logic can be provided in the controller to prevent thermal conductance in certain situations, such as this. Means for cooling auxiliary heat sink 25, such as cooling fins, thermoelectric cooling, etc., may be provided, as mentioned above. It is also possible that auxiliary heat sink 25 could be used for heating (for example for preheating). In this case, means apart from the thermal printing head for heating auxiliary heat sink 25 could be provided (for example, a resistive heating element, etc.)

In FIG. 2, the thermal conductance between auxiliary heat sink 25 and thermal printing head 20 is adjusted mechanically. In the arrangement of FIG. 2, there are essentially two values of the thermal conductance between the thermal printing head 20 and the auxiliary heat sink 25: "high" (when they are in physical contact) and "low" (when they are separated by an insulator, such as an air gap). It will be apparent to one of skill in the art that other means for adjusting the thermal conductance are conceivable (for example, providing a deformable contact surface in which the area of contact varies with pressure, pumping different amounts of fluid between auxiliary heat sink 25 and thermal printing head 20, evaporating a liquid, etc.).

It will also be appreciated that the thermal conductance may be controllable between a minimum and a maximum value and not necessarily either "high" or "low", as is described in more detail below. When only two levels of thermal conductance are attainable, it is nevertheless possible to obtain an average thermal conductance between these two values by alternating between one and the other, as will be readily apparent to one of ordinary skill in the art.

The mechanical adjustment of the thermal conductance between thermal printing head 20 and auxiliary heat sink 25 may be achieved in a variety of ways. Either or both of 20 and 25 may be moved so as to change the area of contact between them. The motion can be achieved through use of a motor, electromechanical actuator, magnetic force. Alternatively, or in addition, the motion can be achieved using a material that changes dimensionally with changes in temperature or pressure. For example, a bimetallic strip or similar device could be used to adjust the area of contact between thermal printing head 20 and auxiliary heat sink 25 as a function of the temperature of thermal printing head 20. In a first configuration, the bimetallic device does not interfere with thermal contact between 20 and 25. Upon heating a sharp change of the bimetallic device reduces or completely eliminates thermal contact.

Figure 3:
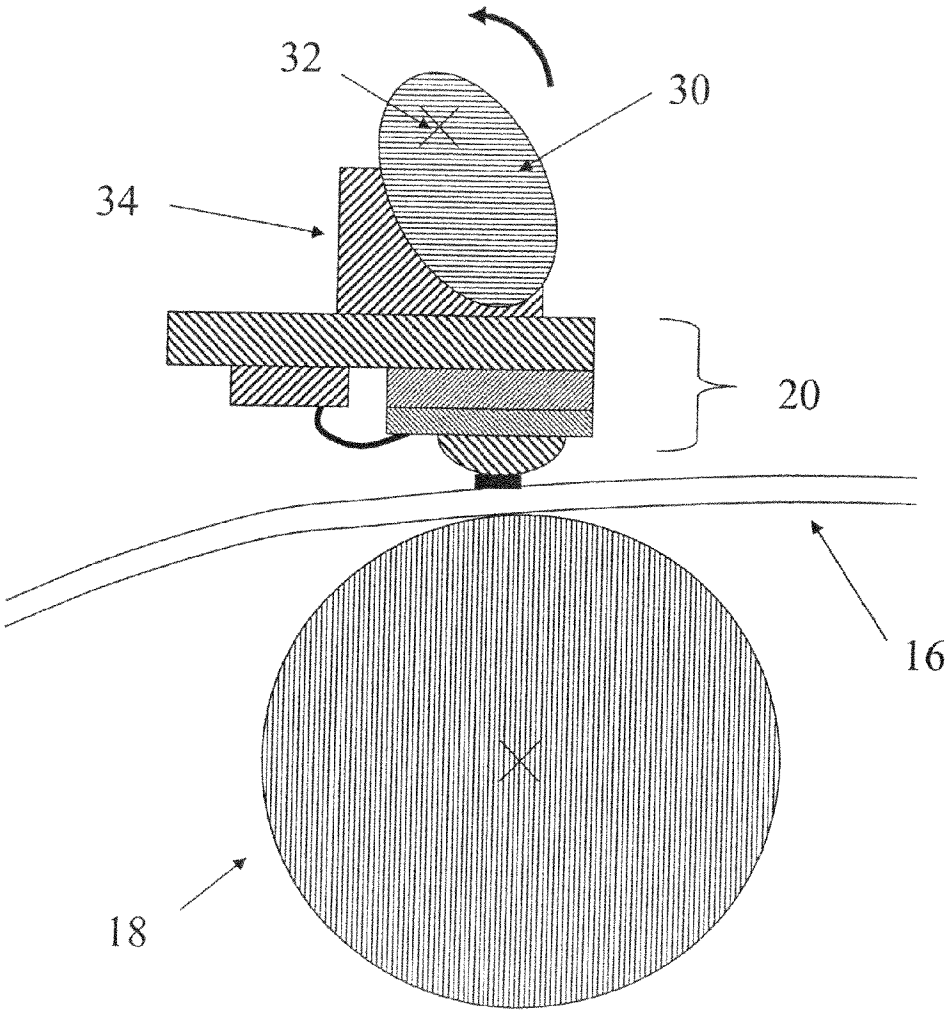
FIG. 3 is an illustration of a means of the present invention for adjusting the thermal conductance between a thermal printing head and an auxiliary heat sink.

FIG. 3 shows an exemplary embodiment of the present invention in which thermal conductance between thermal printing head 20 and auxiliary heat sink 30 is adjustable rotational motion of an auxiliary heat sink 30 (or, equivalently, rotation of an element that is in thermal contact with the auxiliary heat sink). Rotation of the auxiliary heat sink 30 about axis 32 changes the area of contact between the auxiliary heat sink 30 and an element 34 that is in thermal contact with thermal printing head 20. In some embodiments, a thermally conductive element 34 is sufficiently deformable and the interface between the auxiliary heat sink 30 and element 34 sufficiently frictionless that intimate, slidable physical contact between the two 30 and 34 may be obtained.

Figure 4:
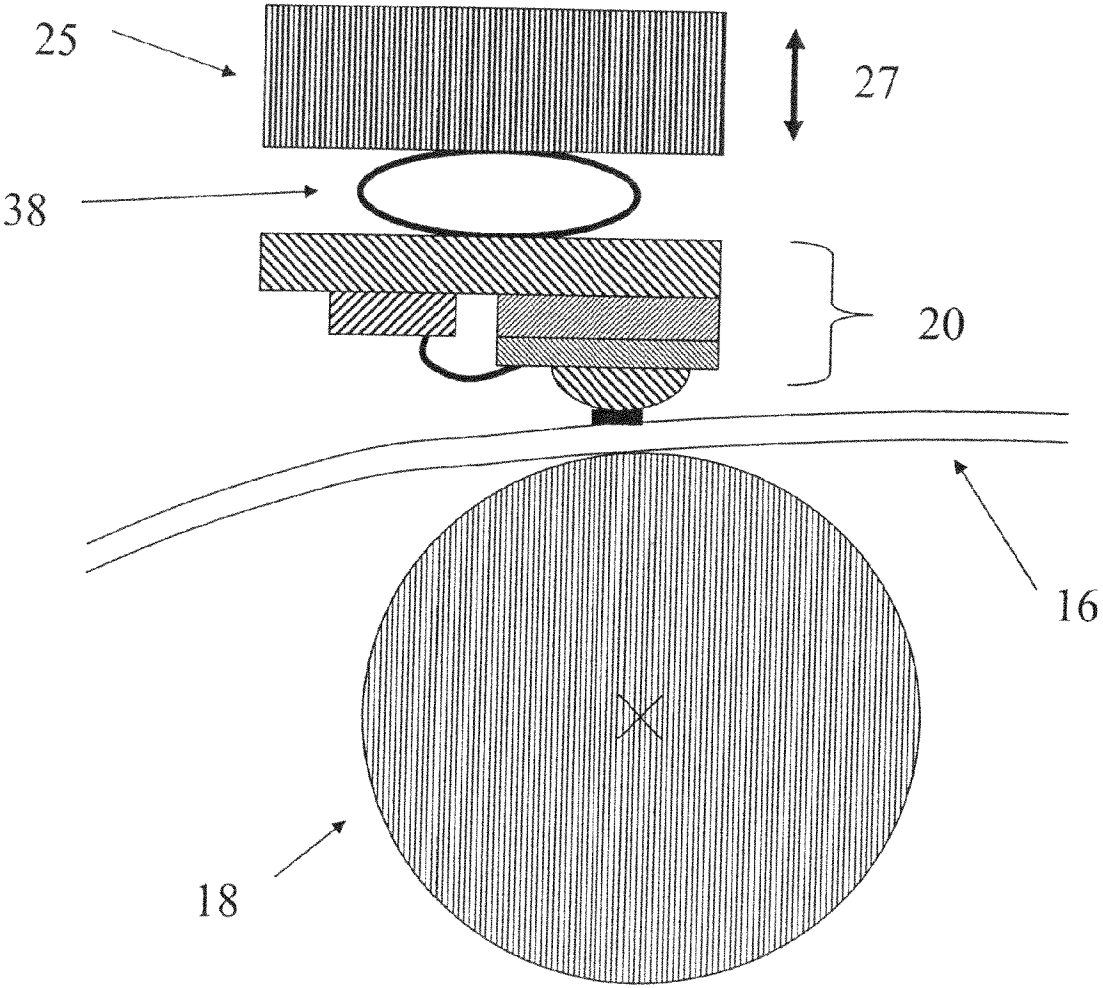
FIG. 4 is an illustration of an alternative means of the present invention for adjusting the thermal conductance between a thermal printing head and an auxiliary heat sink.

FIG. 4 shows an embodiment of the present invention in which the thermal conductance between thermal printing head 20 and auxiliary heat sink 25 can be adjusted by flexion of a thermally conductive, compressible element 38. Although compressible element 38 is shown as a loop in FIG. 4, it will be clear to one of skill in the art that other geometries are possible (for example, coil springs, leaf springs, and thermally conductive elastomers). Element 38 has high thermal conductivity and may, for example, be made from a beryllium/copper alloy. Compression of loop 38 increases the area of contact both between loop 38 and thermal printing head 20 and between loop 38 and auxiliary heat sink 25, thereby increasing the thermal conductance between thermal printing head 20 and auxiliary heat sink 25 through the loop 38.

In yet another embodiment, the thermal conductance between thermal printing head 20 and auxiliary heat sink 25 is achieved using a material whose thermal conductivity changes with temperature. A material could be chosen in which the thermal conductance would be relatively high when the thermal printing head 20 is at a high temperature but relatively low when the thermal printing head 20 is at a low temperature.

A phase change material can be used to conduct heat between the thermal printing head 20 and the auxiliary heat sink 25. In the case of a phase change material that starts as a solid, heat would be conducted through the solid for temperatures below the melting point, but would be transferred through a liquid for temperatures above the melting point, allowing for convective heat transport.

In the case of a liquid phase change material, evaporation and recondensation would allow very efficient heat transfer when the temperature of the thermal printing head 20 is above the boiling temperature, but less efficient heat transfer for temperatures below this temperature (although some evaporation and recondensation will occur at temperatures below the boiling point, at a rate depending upon the vapor pressure of the material). In such cases, the thermally conductive linkage between the thermal printing head 20 and the auxiliary heat sink 25 would be by means of a "heat pipe" mechanism.

Figure 5:
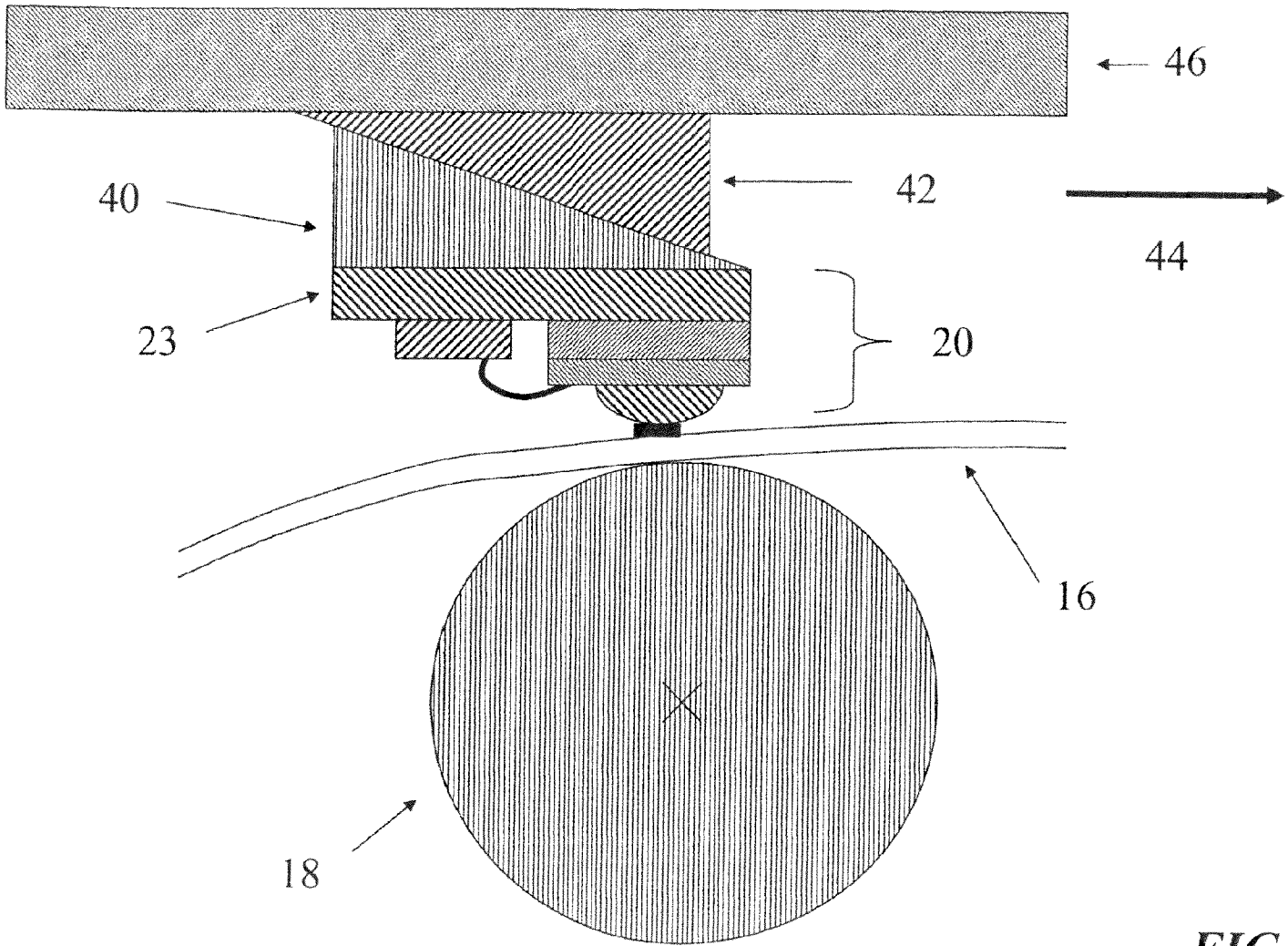
FIG. 5 is a cross-sectional view of yet another alternative thermal printer of the present invention having a thermal printing head and an auxiliary heat sink.

FIG. 5 shows an alternative exemplary embodiment printer of the present invention in which the thermal printing head 20 has been brought into thermal contact with a large body 46 through first and second elements 40 and 42. Body 46 may be the printer chassis or some other component of the printer. Body 46 can be affixed to second element 42 and the two are in thermal contact. Thermal printing head 20 can be affixed to first element 40 (via support 23) and the two are in thermal contact. Body 46, in combination with second element 42, comprises the auxiliary heat sink. Motion of second element 42 relative to first element 40 for example in the direction of arrow 44 can be used to adjust the thermal conductance between the thermal printing head 20 and the auxiliary heat sink.

Figure 6:
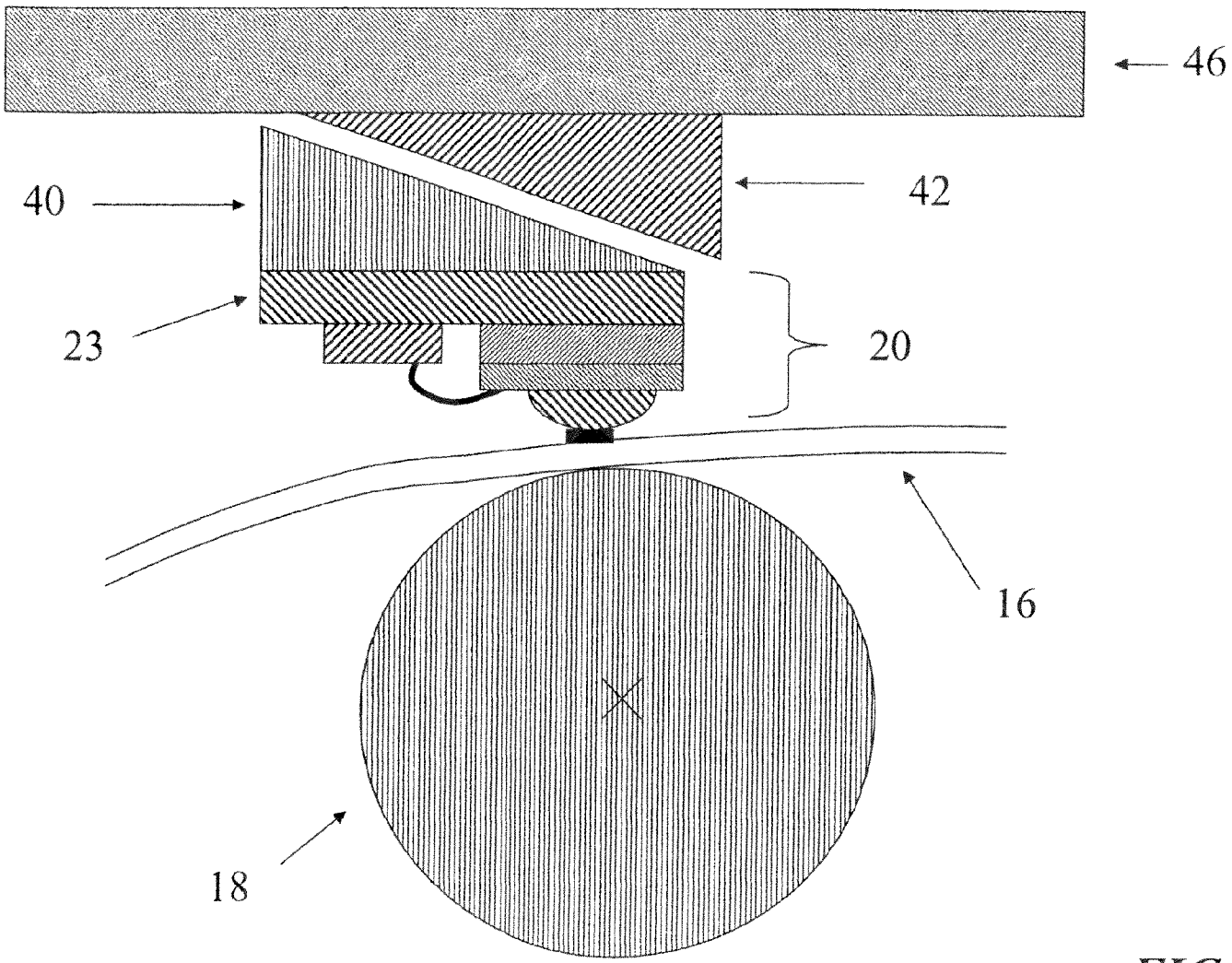
FIG. 6 is a cross-sectional view of the thermal printer of the present invention illustrated in FIG. 5 showing the adjustment of the thermal conductance between the thermal printing head and the auxiliary heat sink.

FIG. 6 shows the printer arrangement of FIG. 5 in the configuration wherein the thermal printing head 20 is no longer in good thermal contact with the auxiliary heat sink comprising body 46 and second element 42. In this embodiment, only a high and a low value of thermal conductance would be achievable, but incorporation of a thermally conductive, compressible loop (or any compressible layer) in the manner illustrated in FIG. 4 would allow for controllable intermediate values. In some embodiments, thermal contact can also be controlled by varying the contact area between first and second elements (i.e., greater surface area leads to greater thermal conductibility).

Using the printer chassis, case, or shell (i.e., any element or elements of the printer itself that is/are at an outer surface of the printer or comprise that outer surface) as the auxiliary heat sink has the advantage that heat may readily be lost to the environment, and not trapped within the structure of the printer itself. For safety, the thermal conductance between the thermal printing head and the chassis should be such that the chassis never exceeds a safe temperature for handling In one possible printer embodiment the thermal printing head is connected to the chassis, case or shell of the printer, and at least a portion of the chassis, case or shell comprises a material with relatively high thermal conductivity, such as a metal. The thermal connection between the thermal printing head and this portion of the chassis, case or shell is such that the outside of the printer never exceeds a comfortable handling temperature, for example, 50° C. at the most. It is preferred that this thermal connection have adjustable thermal conductance, but this is not essential.

Although the invention has been described in detail with respect to various preferred embodiments, it is not intended to be limited thereto, but rather those skilled in the art will recognize that variations and modifications are possible which are within the spirit of the invention and the scope of the appended claims.

What is claimed is:

1. A thermal printer comprising:

(i) a thermal printing head comprising a support and a plurality of heating elements;

(ii) an auxiliary heat sink in selective thermal communication with said thermal printing head;

(iii) a means for adjusting a thermal conductance between said thermal printing head and said auxiliary heat sink; and (iv) at least another auxiliary heat sink, and means by which a thermal conductance between said thermal printing head and each of said auxiliary heat sinks can be individually adjusted.

2. A thermal printer comprising:

(i) a thermal printing head comprising a support and a plurality of heating elements;

(ii) an auxiliary heat sink in selective thermal communication with said thermal printing head; and (iii) means for adjusting a thermal conductance between said thermal printing head and said auxiliary heat sink, wherein said adjustable thermal conductance comprises a thermally conductive member providing relative motion of said thermal printing head with respect to said auxiliary heat sink.

3. A thermal printer comprising:

(i) a thermal printing head comprising a support and as plurality of heating elements, (ii) an auxiliary heat sink in selective thermal communication with said thermal printing head; and (iii) means for adjusting a thermal conductance between said thermal printing head and said auxiliary heat sink, wherein said adjustable thermal conductance between said thermal printing head and said auxiliary heat sink comprises a phase change material in thermal communication with at least one of said thermal printing head and said auxiliary heat sink.

4. The thermal printer of claim 3 in which said phase change material comprises a liquid at room temperature and said adjustable thermal conductance between said thermal printing head and said auxiliary heat sink comprises a heat pipe.

5. The thermal printer of claim 3, in which said phase change material comprises a solid at room temperature.

6. A thermal printer comprising:

(i) a thermal printing head comprising a support and a plurality of heating elements (ii) an auxiliary heat sink in selective thermal communication with said thermal printing head; and (iii) means for adjusting a thermal conductance between said thermal printing head and said auxiliary heat sink, wherein said adjustable thermal conductance between said thermal printing head and said auxiliary heat sink comprises an element having a different shape at a first temperature than at a second temperature.

7. The thermal printer of claim 6 in which said element comprises a bimetallic strip.

8. A thermal printer comprising:

(i) a thermal printing head comprising support and a plurality of heating elements;

(ii) an auxiliary heat sink in selective thermal communication with said thermal printing, head; and (iii) a means for adjusting a thermal conductance between said thermal minting head and said auxiliary heat sink;

wherein said auxiliary heat sink comprises an element of the chassis of said printer.

9. A method of printing using a thermal printer comprising a thermal printing head, a platen roller, and an auxiliary heat sink, wherein the thermal conductance between said thermal printing head and said auxiliary heat sink is adjustable, comprising the steps of (i) setting said thermal conductance to a first value;

(ii) translating said thermal imaging member relative to said thermal printing head, while selectively energizing the heating elements of said thermal printing head;

(iii) monitoring a temperature recorded of said thermal printing head; and (iv) resetting said thermal conductance to a second value if said monitored temperature exceeds a first predetermined threshold, wherein said first value is lower than said second value.

10. The method of claim 9, wherein said thermal conductance is set to said first value upon insertion of a thermal imaging member between said thermal printing head and said platen roller.

11. The method of claim 9, further comprising the step of (v) setting said thermal conductance to said first value responsive to said temperature dropping below a second predetermined threshold.

12. The method of claim 11 wherein said first and second predetermined thresholds are substantially the same.

13. The method of claim 9, wherein resetting said thermal conductance from said first value to said second value comprises moving said thermal printing bead relative to said auxiliary heat sink.

14. The method of claim 9, wherein said thermal printing head and said auxiliary heat sink are nowhere in physical contact when said thermal conductance is set to said first value and in at least partial physical contact when said thermal conductance is reset to said second value.

15. A method of printing using a thermal printer comprising a thermal printing head, a platen roller, and an auxiliary heat sink, wherein the thermal conductance between said thermal printing head and said auxiliary heat sink is adjustable, comprising the steps of:

(i) monitoring the temperature of said thermal printing head prior to printing;

(ii) initializing a temperature of said thermal printing head to a predetermined value, while said thermal conductance is set at a first value;

(iii) translating said thermal imaging member relative to said thermal printing head while selectively energizing the heating elements of said thermal printing head; and (iv) setting said thermal conductance to a second value if said temperature exceeds another predetermined threshold, wherein said first value is lower than said second value.

16. The method of claim 15, wherein initializing said temperature comprises preheating said thermal printing head until said temperature reaches a predetermined value.

* * * * *

UNITED STATES PATENT AND TRADEMARK OFFICE

CERTIFICATE OF CORRECTION

PATENT NO. : 7,825,945 B2
APPLICATION NO. : 11/856482
DATED : November 2, 2010
INVENTOR(S) : Brian Busch et al.

It is certified that error appears in the above-identified patent and that said Letters Patent is hereby corrected as shown below:

In column 9, line 17, please delete the word “as” and insert --a-- therefor.

In column 9, line 49, please insert the word --a-- before the word “support”.

In column 9, line 51, please delete “printing, head” and insert --printing head-- therefor.

In column 9, line 53, please delete the word “minting” and insert --printing-- therefor.

In column 10, line 28, please delete the word “bead” and insert --head-- therefor.

Signed and Sealed this
Twenty-second Day of February, 2011

David J. Kappos

David J. Kappos
*Director of the United States Patent and Trademark Office*